United States Patent [19]

Wessling et al.

[11] 4,178,205

[45] Dec. 11, 1979

[54] HIGH STRENGTH NON-WOVEN FIBROUS MATERIAL

[75] Inventors: Ritchie A. Wessling; William A. Foster, both of Midland; Dale M. Pickelman, Auburn, all of Mich.

[73] Assignee: The Dow Chemical Company, Midland, Mich.

[21] Appl. No.: 825,319

[22] Filed: Aug. 17, 1977

[51] Int. Cl.[2] ..... D21H 3/38

[52] U.S. Cl. ..... 162/168 R; 162/168 N

[58] Field of Search ..... 162/168 R, 168 N, 168 NA, 162/169; 260/29.6 T

[56] References Cited

U.S. PATENT DOCUMENTS

| | | | |
|---|---|---|---|
| 2,563,897 | 8/1951 | Wilson et al. | 162/166 |
| 2,654,671 | 10/1953 | Azorlosa | 162/168 N |
| 3,016,325 | 1/1962 | Pattilloch | 162/164 R |
| 3,329,560 | 7/1967 | Schickh et al. | 162/168 N |
| 3,694,393 | 9/1972 | Lewis et al. | 260/29.6 |
| 3,926,890 | 12/1975 | Huang et al. | 260/29.6 TA |
| 3,937,648 | 2/1976 | Huebner et al. | 162/168 R |
| 4,017,440 | 4/1977 | Killam et al. | 162/168 N |
| 4,056,501 | 11/1977 | Gibbs et al. | 260/29.6 SQ |

OTHER PUBLICATIONS

Alincie et al., *J.A.P.S.*, 20, 2209–2219 (1976).

*Primary Examiner*—S. Leon Bashore
*Assistant Examiner*—William F. Smith
*Attorney, Agent, or Firm*—I. A. Murphy

[57] ABSTRACT

A high strength, non-woven fibrous material is prepared by (a) mixing an aqueous slurry of a negatively charged, water-insoluble natural or synthetic fiber or blend of fibers with an amount up to the fiber charge reversal point of a structured particle latex having pH independent cationic charges bound at or near the particle surface to form an aqueous suspension, (b) draining water from the aqueous suspension to form a wet web (c) wet pressing the web and (d) drying the web by heating.

11 Claims, No Drawings

HIGH STRENGTH NON-WOVEN FIBROUS MATERIAL

BACKGROUND OF THE INVENTION

1. Field of the Invention

The invention is concerned with the use of a cationic latex by wet-end addition in a process for making high strength non-woven fibrous material and the product formed by such a process.

2. Description of the Prior Art

The use of a latex in the manufacture of non-woven materials by wet-end addition, or as a beater additive, is well known. Commonly, the latex has been an anionic latex but a water-soluble cationic deposition aid has been used therewith. Because of the slightly anionic nature of pulp, it has been suggested particularly for paper manufacture that a low-charge density cationic latex should be used in order to get good deposition on the fibers without the use of a deposition aid. However, it has been considered necessary to use a low charge latex to get efficient deposition of the latex. The prior art teaches the utility of bound charge in a wet-end process but does not teach nor suggest the advantage of using high levels of bound charge in a structured particle latex to get high strength in the products.

SUMMARY OF THE INVENTION

It has been discovered that high strength non-woven fibrous materials can be prepared by mixing an aqueous slurry of a negatively charged fiber with a specific kind of cationic latex in an amount up to the charge reversal point of the fiber, draining water from the resulting aqueous suspension to form a wet web, wet pressing the web and drying the web by heating. The latex comprises structured particles having a non-ionic polymer core encapsulated by a thin polymer layer having a high density of bound, pH independent, cationic charges. The polymer core has a glass transition temperature (Tg) from −80° to 100° C., preferably from about −25° C. to about 40° C.

DESCRIPTION OF THE PREFERRED EMBODIMENTS

The product and process of this invention requires a fiber having a negative charge and a specific kind of cationic latex in specific ratios to prepare a high strength non-woven material.

Of particular importance is that the cationic latex is used in an amount below that required to cause charge reversal on the fiber. The use of a deposition aid is not a significant factor. An advantage of the process and product of this invention is that the polymer from the latex is uniformly distributed on the fiber and is bonded thereto. Consequently stronger webs are obtained.

The fiber is any kind of negatively charged, water-insoluble, natural or synthetic fiber or blend of fibers which can be dispersed in aqueous slurry. Either long or short fibers, or mixtures thereof are useful. Suitable also are reclaimed waste papers and cellulose from cotton and linen rags, straws, glass fibers and the like. Particularly useful fibers are the cellulosic and lignocellulosic fibers commonly known as wood pulp of the various kinds such as mechanical pulp, steam-heated mechanical pulp, chemimechanical pulp, semichemical pulp and chemical pulp. Specific examples are groundwood pulp, unbleached sulfite pulp, bleached sulfite pulp, unbleached sulfate pulp and bleached sulfate pulp.

The process is valuable in being able to use crude, low quality pulp such as "screenings", i.e., coarse by-product from unbleached chemical pulps.

The cationic latex comprises a water-insoluble copolymer having particles with a high density of pH independent bound charges at or near the particle surface in an amount such as from about 0.15 milliequivalent to about 0.6 milliequivalent, preferably from about 0.18 milliequivalent to about 0.4 milliequivalent, per gram of copolymer. The composition of the latex copolymer is such as to provide a glass transition temperature (Tg) from about −80° to about 100° C., preferably from about −25° C. to about 40° C. Ordinarily, tensile strength of the product increases as the Tg increases up to the point where the polymer does not fuse properly with the times and temperatures encountered in the wet-end process.

The latexes are structured particle latexes having a non-ionic polymer core encapsulated by a thin polymer layer having bound charges as pH independent cationic groups at or near the particle surface. One method of obtaining such latexes is by copolymerizing under emulsion polymerization conditions an ethylenically unsaturated, activated-halogen monomer onto the particle surface of a non-ionic, organic polymer which is slightly cationic through the presence of adsorbed cationic surfactant. The resulting latex is reacted with a non-ionic nucleophile to form a latex suitable for use in the practice of this invention.

Latexes prepared by the usual emulsion polymerization conditions have high enough molecular weight to be useful. Usually the degree of polymerization will be greater than about 1000. The lower limit can be expressed as the start of the plateau region when properties are plotted against molecular weight. The particle size of the latex also has a significant effect. Tensile strength of the product increases as the particle size of the latex decreases. Ordinarily the particle size for best results will be below 1500 Angstroms, especially from about 600 Angstroms to about 1000 Angstroms.

Representative useful latexes and further details of the method of preparation are described and claimed in the copending application of Gibbs et al., Ser. No. 569,723 filed Apr. 21, 1975, now U.S. Pat. No. 4,056,501, the entire specification being incorporated herein by reference.

By "bound" as applied to groups or charges in this specification is meant that they are not desorbable under the conditions of processing. A convenient test is by dialysis against deionized water.

By the term "pH independent groups" as applied to ionic groups is meant that the groups are predominantly in ionized form over a wide range in pH, e.g., 2–12. Representative of such groups are sulfonium, sulfoxonium, isothiouronium, pyridinium and quaternary ammonium.

By the term "non-toxic" as applied to the monomers in this specification is meant that the monomers are not ionic per se nor do not become ionic by a simple change in pH. For illustration, while a monomer containing an amine group is non-ionic at high pH, the addition of a water-soluble acid reduces the pH and forms a water-soluble salt; hence, such a monomer is not included. The non-ionic nucleophiles, however, are not similarly restricted, i.e., "non-ionic" as used with nucleophiles applies to such compounds which are non-ionic under conditions of use and tertiary amines, for example, are included.

Optional wet-end constituents used in the process to make the products of this invention include pigments and other common wet-end additives. While conventional deposition aids may be used, there is no particular advantage obtained thereby.

The maximum amount of cationic latex used in the practice of this invention is not significantly greater than the amount required to reach the charge neutralization point of the fiber being used. Hence, the amount of latex depends on the charge on the latex and the charge on the fiber. As the charge on the fiber is increased, the amount of a particular latex which can be used is increased with a resulting higher tensile strength in the product. For a particular fiber, as the charge on the latex is increased the amount of latex which can be used is decreased. At a particular level of latex, the tensile strength normally increases with the charge density on the latex particle up to the point where the structured particle morphology is lost, i.e., when the particle becomes soluble or a microgel. The amount of cationic latex usually ranges from about 0.5 percent to about 5 percent of solids based on the dry weight of the fiber.

The process to prepare the product of this invention preferably is carried out as follows: A dilute aqueous suspension of the fiber is formed in the normal manner often in a concentration of from about 0.5 percent to about 6 percent. The latex is added at any convenient concentration, often in the concentration as supplied and the resulting mixture is stirred, usually for at least two minutes depending somewhat on the equipment available. The aqueous suspension usually is then diluted further, often with white water from the process. Optional wet-end additives can be added at any suitable time. A wet web is formed by flowing the resulting suspension over a porous support such as a screen, draining the wet web, wet pressing and completely drying the web by heating. Pressing and heating may be carried out simultaneously. Alternatively, ambient temperature pressing followed by heating to complete drying may be employed. Optionally, other compacting, shaping, tempering and curing steps may be included. The temperatures used for hot pressing, curing and tempering or other heating steps often are from about 100° C. to about 250° C., although higher or lower temperatures are operable. The product is prepared from the resulting suspension, for example, on a paper machine such as a Fourdrinier machine or a cylinder machine or in a laboratory sheet forming apparatus.

The product is dried, non-woven fibrous web with one dimension much smaller than the other two with the fibers uniformly distributed through the smaller dimension, preferentially oriented in the plane of the web and bonded to a uniformly distributed polymer phase formed from a structured particle latex.

The following examples illustrate ways in which the present invention may be carried out, but should not be construed as limiting the invention. All parts and percentages are by weight unless otherwise expressely indicated.

Unless indicated otherwise, the latexes for the examples were prepared according to the following summary of a process described in greater detail in copending application Ser. No. 569,723, filed Apr. 21, 1975, now U.S. Pat. No. 4,056,501. A base latex was prepared by batch emulsion polymerization from the monomers shown in Table I using dodecylbenzyldimethylsulfonium chloride as surfactant. The particles of the base latex were encapsulated (capped) with a copolymer of vinylbenzyl chloride by adding "cap monomers" of the kind and in the proportions shown in Table I in a continuously added manner over about one hour under emulsion polymerization conditions. The resulting latex was mixed with an excess of a nucleophile and was allowed to react to form a bound charge on the latex particles. The reaction was stopped at the desired degree of charge by removing the excess nucleophile by distillation. Except as otherwise indicated the nucleophile was dimethylsulfide and accordingly the resulting pH independent cationic group was sulfonium. In those examples where the quaternary ammonium group is indicated, the nucleophile was 2-(dimethylamino)ethanol.

TABLE I

| | Base Latex[a] | | | Cap[a] | | | Structured-Particle Latex | | | |
|---|---|---|---|---|---|---|---|---|---|---|
| | | | | | | | Composition | | Bound | Particle |
| Latex | St % | Bd % | Tg °C. | St % | Bd % | VBC % | Cap % | VBC % | Charge meq/g | Size Angstroms |
| A-1 | 65 | 35 | 2 | 15 | 35 | 50 | 10 | 5 | 0.102 | 1360 |
| A-2 | 65 | 35 | 2 | 15 | 35 | 50 | 10 | 5 | 0.112 | 1360 |
| A-3 | 65 | 35 | 2 | 15 | 35 | 50 | 10 | 5 | 0.127 | 1360 |
| B-1 | 65 | 35 | 2 | 15 | 35 | 50 | 20 | 10 | 0.160 | 1480 |
| B-2 | 65 | 35 | 2 | 15 | 35 | 50 | 20 | 10 | 0.265 | 1480 |
| B-3 | 65 | 35 | 2 | 15 | 35 | 50 | 20 | 10 | 0.298 | 1480 |
| C | 65 | 35 | 2 | | 50 | 50 | 13 | 6.5 | 0.221 | 800 |
| D | 65 | 35 | 2 | | 50 | 50 | 13 | 6.5 | 0.171 | 910 |
| E | 65 | 35 | 2 | | 50 | 50 | 13 | 6.5 | 0.178 | 1480 |
| F | 65 | 35 | 2 | | 50 | 50 | 13 | 6.5 | 0.142 | 1880 |
| G | 65 | 35 | 2 | | 50 | 50 | 13 | 6.5 | 0.203[b] | 1360 |
| H | 50 | 50 | −21 | | 50 | 50 | 13 | 6.5 | 0.204 | 1230 |
| I | 55 | 45 | −15 | | 50 | 50 | 13 | 6.5 | 0.172 | 1190 |
| J | 60 | 40 | −8 | | 50 | 50 | 13 | 6.5 | 0.173 | 1335 |
| K | 65 | 35 | 2 | | 50 | 50 | 13 | 6.5 | 0.199 | 1360 |
| L | 70 | 30 | 20 | | 50 | 50 | 13 | 6.5 | 0.193 | 1320 |

[a]Monomers: St = styrene; Bd = butadiene; VBC = vinylbenzylchloride
[b]Bound quaternary ammonium group; others are sulfonium

EXAMPLE 1

An aqueous dispersion containing 1393 parts of water having a hardness of 106 ppm (calculated as calcium carbonate) and an alkalinity of 48 ppm (calculated as calcium carbonate) and 7 parts (dry basis) of unbleached Canadian softwood kraft having a Canadian Standard Freeness (CSF) of 540 millimeters was stirred at such rate that the kraft was just turning over gently. To the moving kraft suspension was added 0.2 part (3 percent of fiber), dry weight basis, of the latex shown in Table II and the resulting mixture, having a pH between 7 and 8 (unadjusted), was stirred for an additional 2.5 minutes. The resulting furnish was made into a handsheet (3.3 grams, 8 in.×8 in.).

A handsheet (Comparative Example 1-C) was prepared in the same manner except the latex was omitted.

Data are shown in Table II.

EXAMPLES 2-6

Additional handsheets were made in the same manner using the same components in the same proportions except that a different latex was used. Data are shown in Table II.

TABLE II

| Ex. No. | Latex | Bound Charge meq/g | Tensile (a) |
|---|---|---|---|
| 1 | A-1 | 0.102 | 9,384 |
| 2 | A-2 | 0.112 | 9,741 |
| 3 | A-3 | 0.127 | 9.831 |
| 4 | B-1 | 0.160 | 10,479 |
| 5 | B-2 | 0.265 | 11,082 |
| 6 | B-3 | 0.298 | 10,724 |
| 1-C | none | — | 8,959 |

(a)Breaking length, meters

All of the handsheets shown in Table II (exept 1-C) showed uniform distribution of the latex on the fiber.

EXAMPLES 7-10

Addition handsheets were prepared in the same manner as described in Example 1 except that different latexes with differing particle sizes were used and the pH of the furnish was adjusted to 4.5 to 5 with sulfuric acid.

Data are shown in Table III.

All of the handsheets of these examples showed uniform distribution of the latex polymer on the fibers.

A comparative handsheet (7-C) was prepared in the same manner except that no latex was used. Data for this comparative example also are shown in Table III.

TABLE III

| Ex. No. | Latex | Bound Charge meq/g | Particle Size Angstroms | Tensile (a) |
|---|---|---|---|---|
| 7 | C | 0.221 | 800 | 10,791 |
| 8 | D | 0.171 | 910 | 10,501 |
| 9 | E | 0.178 | 1480 | 10,233 |
| 10 | F | 0.142 | 1880 | 10,054 |
| 7-C | none | — | — | 9,049 |

(a)Breaking length, meters

EXAMPLES 11-16

Handsheets were prepared in the same manner except different latexes were used and the size of each handsheet was 12 in.×12 in. (7.5 grams). The latex for Example 11 had bound quaternary ammonium groups and the other examples had sulfonium groups. The handsheets showed uniform distribution of latex in the fibers.

Data are shown in Table IV for the above examples and also for comparative Example 16-C which was prepared in the same manner except that no latex was used.

TABLE IV

| Ex. No. | Latex Kind | Latex Core Tg °C. | Latex Bound Charge meq/g | Handsheet Tensile (b) |
|---|---|---|---|---|
| 11 | G | 2 | 0.203[a] | 10,751 |
| 12 | H | −21 | 0.204 | 9,843 |
| 13 | I | −15 | 0.172 | 9,932 |
| 14 | J | −8 | 0.173 | 10,109 |
| 15 | K | 2 | 0.199 | 10,529 |
| 16 | L | 20 | 0.193 | 11,657 |
| *16-C | — | — | — | 9,821 |

*Not an example of this invention
[a]Quaternary ammonium rather than sulfonium
[b]Breaking length, meters Tests referred to in the examples were carried out as follows:

Tensile:

Tensile values are recorded as breaking length, in meters, and are determined according to TAPPI Standard T 494-os-70 except the values are the average of 3 samples rather than 10 and the jaw gap is 2 inches rather than 8 inches.

Canadian Standard Freeness (CSF):

The values are determined according to TAPPI Standard T 227-M-58 except where variations in the procedure are indicated.

Glass Transition Temperature (Tg): The values are derived from "Encyclopedia of Polymer Science and Technology", John Wiley & Sons, N.Y., 1970, Vol. 13, page 322, especially FIG. 8.

That which is claimed is:

1. A method for preparing non-woven fibrous web comprising:

(a) mixing an aqueous slurry of a negatively charged, water-insoluble, natural or synthetic fiber or a blend of such fibers with a structured particle latex having particles consisting of a non-ionic organic polymer core encapsulated by a thin polymer layer having bound charges of pH independent cationic groups, said charges being present in an amount of from about 0.15 milliequivalent to about 0.6 milliequivalent per gram of polymer in the latex; the non-ionic polymer core having a glass transition temperature of from about −80° C. to about 100° C.; the amount of said latex being not greater than the amount required to cause charge reversal on the fiber;

(b) draining water from the aqueous suspension to form a wet web;

(c) wet pressing the web; and (d) heating the wet web; whereby there is formed a non-woven fibrous web having polymer uniformly distributed and bonded to the fiber.

2. The process of claim 1 in which the fiber is a papermaking pulp and the product is paper.

3. The process of claim 1 in which the pH independent group is sulfonium.

4. The process of claim 1 in which the pH independent cationic group is quaternary ammonium.

5. The process of claim 1 in which the particle diameter is less than 1500 Angstroms.

6. The process of claim 5 in which the particle diameter is from about 600 Angstroms to about 1000 Angstroms.

7. The process of claim 1 in which the amount of latex is from about 0.5 percent to about 5 percent of the weight of the fiber, calculated on a dry weight basis.

8. The process of claim 1 in which the glass transition temperature is from about −25° C. to about 40° C.

9. The process of claim 1 in which the amount of bound charge is from about 0.18 milliequivalent to about 0.4 milliequivalent per gram of polymer in the latex.

10. The non-woven fibrous material obtained by the process of claim 1.

11. The non-woven fibrous material obtained by the process of claim 2.

* * * * *

UNITED STATES PATENT AND TRADEMARK OFFICE

CERTIFICATE OF CORRECTION

PATENT NO. : 4,178,205

DATED : December 11, 1979

INVENTOR(S) : Ritchie A. Wessling; William A. Foster; Dale M. Pickelman

It is certified that error appears in the above-identified patent and that said Letters Patent are hereby corrected as shown below:

Col. 2, line 3, after "duct" insert --pulp--.

Col. 2, line 31, delete "the".

Col. 2, line 36, begin a new paragraph starting with the sentence "The particle . . .".

Col. 2, line 59, delete " "non-toxic" " and insert --"non-ionic"--.

Col. 4, line 5, after "is" insert --a--.

Col. 4, line 14, delete "expressely" and insert --expressly--.

Col. 4, line 67, delete "millimeters" and insert --milliliters--.

Col. 5, Table II in Example 3 under the heading "Tensile (a)", delete "9.831" and insert --9,831--.

Col. 5, line 30, delete "exept" and insert --except--.

Signed and Sealed this

*Thirteenth* Day of *May 1980*

[SEAL]

*Attest:*

SIDNEY A. DIAMOND

*Attesting Officer*

*Commissioner of Patents and Trademarks*